US009247827B2

(12) United States Patent
Lin et al.

(10) Patent No.: US 9,247,827 B2
(45) Date of Patent: Feb. 2, 2016

(54) MULTI-CHAMBER INFLATABLE DEVICE

(71) Applicant: Intex Recreation Corporation, Long Beach, CA (US)

(72) Inventors: Hua Hsiang Lin, Haicang (CN); Yaw Yuan Hsu, Haicang (CN)

(73) Assignee: Intex Recreation Corp., Long Beach, CA (US)

( * ) Notice: Subject to any disclaimer, the term of this patent is extended or adjusted under 35 U.S.C. 154(b) by 0 days.

(21) Appl. No.: 14/599,091

(22) Filed: Jan. 16, 2015

(65) Prior Publication Data

US 2015/0201760 A1 Jul. 23, 2015

Related U.S. Application Data

(63) Continuation-in-part of application No. 29/502,063, filed on Sep. 11, 2014.

(30) Foreign Application Priority Data

Jan. 17, 2014 (CN) ..... 2014 2 0029512 U

(51) Int. Cl.
*A47C 27/10* (2006.01)
*A47C 27/08* (2006.01)

(52) U.S. Cl.
CPC ..... *A47C 27/10* (2013.01); *A47C 27/081* (2013.01); *A47C 27/087* (2013.01)

(58) Field of Classification Search
CPC ..... A47C 27/10; A47C 27/081; A47C 27/087
USPC ..... 5/706, 710–712, 739
See application file for complete search history.

(56) References Cited

U.S. PATENT DOCUMENTS

| | | | | |
|---|---|---|---|---|
| 2,604,641 | A | 7/1952 | Reed | |
| 5,561,873 | A | 10/1996 | Weedling | |
| 5,598,593 | A * | 2/1997 | Wolfe | 5/710 |
| D414,365 | S | 9/1999 | Hsu et al. | |
| D414,644 | S | 10/1999 | Hsu et al. | |
| 5,960,495 | A | 10/1999 | Hsu et al. | |
| 6,076,214 | A | 6/2000 | Klimenko | |
| 6,568,011 | B2 | 5/2003 | Fisher et al. | |
| 6,618,884 | B1 * | 9/2003 | Wu | 5/706 |
| 7,089,618 | B1 * | 8/2006 | Metzger | 5/709 |
| 7,353,555 | B2 * | 4/2008 | Lau | 5/711 |

(Continued)

OTHER PUBLICATIONS

Beautyrest Countour Aire Mattress, available at least as early as Jul. 22, 2013, 1 page.

*Primary Examiner* — Michael Trettel
(74) *Attorney, Agent, or Firm* — Faegre Baker Daniels LLP

(57) ABSTRACT

A multi-chamber inflatable mattress includes a main air chamber, upper and lower peripheral air chambers, and an upper air chamber. The main air chamber includes internal tensioning structures which cooperate with a bottom mattress panel and a lower intermediate panel to provide a generally box-shaped, mattress-sized inflatable structure upon pressurization. A second, upper intermediate panel cooperates with a top mattress panel to define an upper air chamber which defines the sleeping surface. The main air chamber receives pressurized fluid directly from a valve, while the lower and upper peripheral air chambers are in direct fluid communication with the main air chamber but not the valve. The upper air chamber is in direct fluid communication with the upper peripheral air chamber, but not the main chamber or valve.

20 Claims, 5 Drawing Sheets

(56) References Cited

U.S. PATENT DOCUMENTS

| | | | | |
|---|---|---|---|---|
| 7,610,642 | B2 * | 11/2009 | Boyd | 5/712 |
| 8,661,590 | B2 * | 3/2014 | Chen | 5/711 |
| 2003/0188388 | A1 | 10/2003 | Boso et al. | |
| 2007/0283499 | A1 * | 12/2007 | Lin et al. | 5/712 |
| 2008/0148488 | A1 * | 6/2008 | Wu | 5/711 |
| 2009/0165211 | A1 * | 7/2009 | Song et al. | 5/706 |
| 2009/0320211 | A1 * | 12/2009 | Lau | 5/713 |

* cited by examiner

MULTI-CHAMBER INFLATABLE DEVICE

CROSS REFERENCE TO RELATED APPLICATIONS

This application claims priority under 35 U.S.C. §119 to Chinese Patent Application No. 201420029512.6, filed Jan. 17, 2014 and entitled "A Double Chamber Air Bed Structure", the entire disclosure of which is hereby incorporated by reference herein. This application is a continuation-in-part of U.S. Design patent application Ser. No. 29/502,063, filed Sep. 11, 2014 and entitled "Inflatable Mattress", the entire disclosure of which is hereby incorporated by reference herein.

BACKGROUND

1. Technical Field

The present disclosure relates to an inflatable product structure and, in particular, to an inflatable mattress with multiple air chambers served from a single inflation valve.

2. Description of the Related Art

Inflatable products are lightweight, easy to transport and require minimal space for storage. Inflatable product technologies have been used for various outdoor items, household goods, and toys, including inflatable mattresses.

A traditional inflatable mattress includes bottom and top panels forming the top and bottom surfaces of the mattress respectively, joined by a peripheral mattress panel to form a substantially air tight internal cavity which can be inflated into the shape of a mattress. In order to maintain generally flat upper and lower surfaces similar to a regular mattress, the upper and lower mattress panels may be joined to one another within the air cavity, such as by tension bands or other internal structures.

Some air mattress designs utilize multiple air chambers which, when pressurized, define additional shapes and features of the mattress. For example, some inflatable mattress designs feature a "double-chamber" construction including lower and upper chambers, in which the upper chamber provides a sleeping surface while the lower chamber provides a ground engaging surface. In some cases, the upper and lower chambers are in fluid communication with one another such that both chambers are inflatable and deflatable via a single valve.

SUMMARY

The present disclosure provides a multi-chamber inflatable mattress including a main air chamber, upper and lower peripheral air chambers, and an upper air chamber. The main air chamber includes internal tensioning structures which cooperate with a bottom mattress panel and a lower intermediate panel to provide a generally box-shaped, mattress-sized inflatable structure upon pressurization. A second, upper intermediate panel cooperates with a top mattress panel to define an upper air chamber which defines the sleeping surface. The lower peripheral air chamber is formed at the periphery of the ground contacting surface of the mattress, and is shaped to provide stability. Similarly, the upper peripheral chamber is formed at the periphery of the upper or sleeping surface of the mattress and provides a ridge around the sleeping surface for user security. The main air chamber receives pressurized fluid directly from a valve, while the lower and upper peripheral air chambers are in direct fluid communication with the main air chamber but not the valve. The upper air chamber is in direct fluid communication with the upper peripheral air chamber, but not the main chamber or valve.

In one form thereof, the present disclosure provides a multi-chamber inflatable mattress including: a bottom panel; a top panel spaced from the bottom panel and defining an upper sleeping surface of the mattress; a peripheral panel bonded to the bottom panel and the top panel to define an internal mattress cavity; an upper intermediate panel disposed between the top panel and the bottom panel; a lower intermediate panel disposed between the bottom panel and the upper intermediate panel; a valve in fluid communication with the internal mattress cavity such that the mattress can be inflated and deflated via the valve; a main air chamber bounded by the bottom panel, the top panel and the peripheral panel, the main air chamber in direct fluid communication with an ambient atmosphere via the valve; an upper peripheral air chamber disposed at a periphery of the top panel, the upper peripheral air chamber in direct fluid communication with the main air chamber and in secondary fluid communication with the ambient atmosphere; and an upper air chamber disposed between the top panel and the upper intermediate panel, the upper air chamber in direct fluid communication with the upper peripheral air chamber, in secondary fluid communication with the main air chamber and in tertiary fluid communication with the ambient atmosphere.

In another form thereof, the present disclosure provides a multi-chamber inflatable mattress including: a main air chamber defined by a ground-contacting surface and a peripheral wall extending upwardly from the ground-contacting surface, the main air chamber in direct fluid communication with an ambient atmosphere via a valve disposed in the peripheral wall; an upper air chamber disposed above the main air chamber with least two intermediate panels between the main air chamber and the upper air chamber, the upper air chamber defined by a sleeping surface; and an upper peripheral air chamber disposed at a periphery of an upper edge of the peripheral wall of the main air chamber, the upper peripheral air chamber in direct fluid communication with the main air chamber and in secondary fluid communication with the ambient atmosphere, the upper air chamber in direct fluid communication with the upper peripheral air chamber, in secondary fluid communication with the main air chamber and in tertiary fluid communication with the ambient atmosphere.

In yet another form thereof, the present disclosure provides a multi-chamber inflatable mattress including: a main air chamber; an upper peripheral air chamber; an upper air chamber; first means for inflating and deflating the main air chamber, said first means placing the main air chamber in direct fluid communication with an ambient atmosphere; second means for inflating and deflating the upper peripheral air chamber, said second means placing the upper peripheral air chamber in secondary fluid communication with the ambient atmosphere; and third means for inflating and deflating the upper air chamber, said third means placing the upper air chamber in tertiary fluid communication with the ambient atmosphere.

BRIEF DESCRIPTION OF THE DRAWINGS

The above-mentioned and other features and advantages of this disclosure, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates an exemplary embodiment of the present invention, and such exemplification is not to be construed as limiting the scope of the invention in any manner.

DETAILED DESCRIPTION

Figure 1:
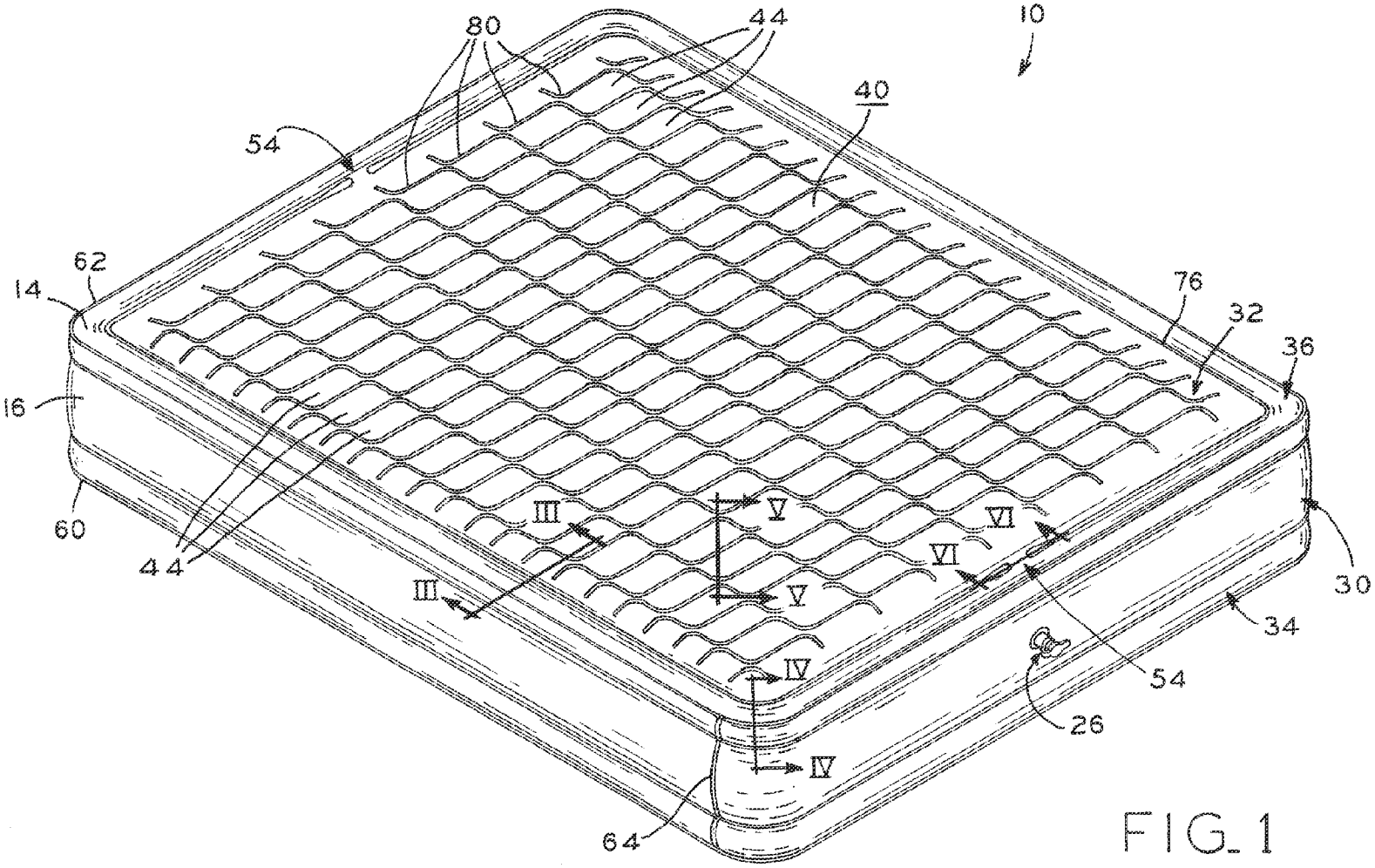
FIG. 1 is a perspective view of a mattress made in accordance with the present disclosure, illustrating the sleeping surface thereof when pressurized.
Figure 3:
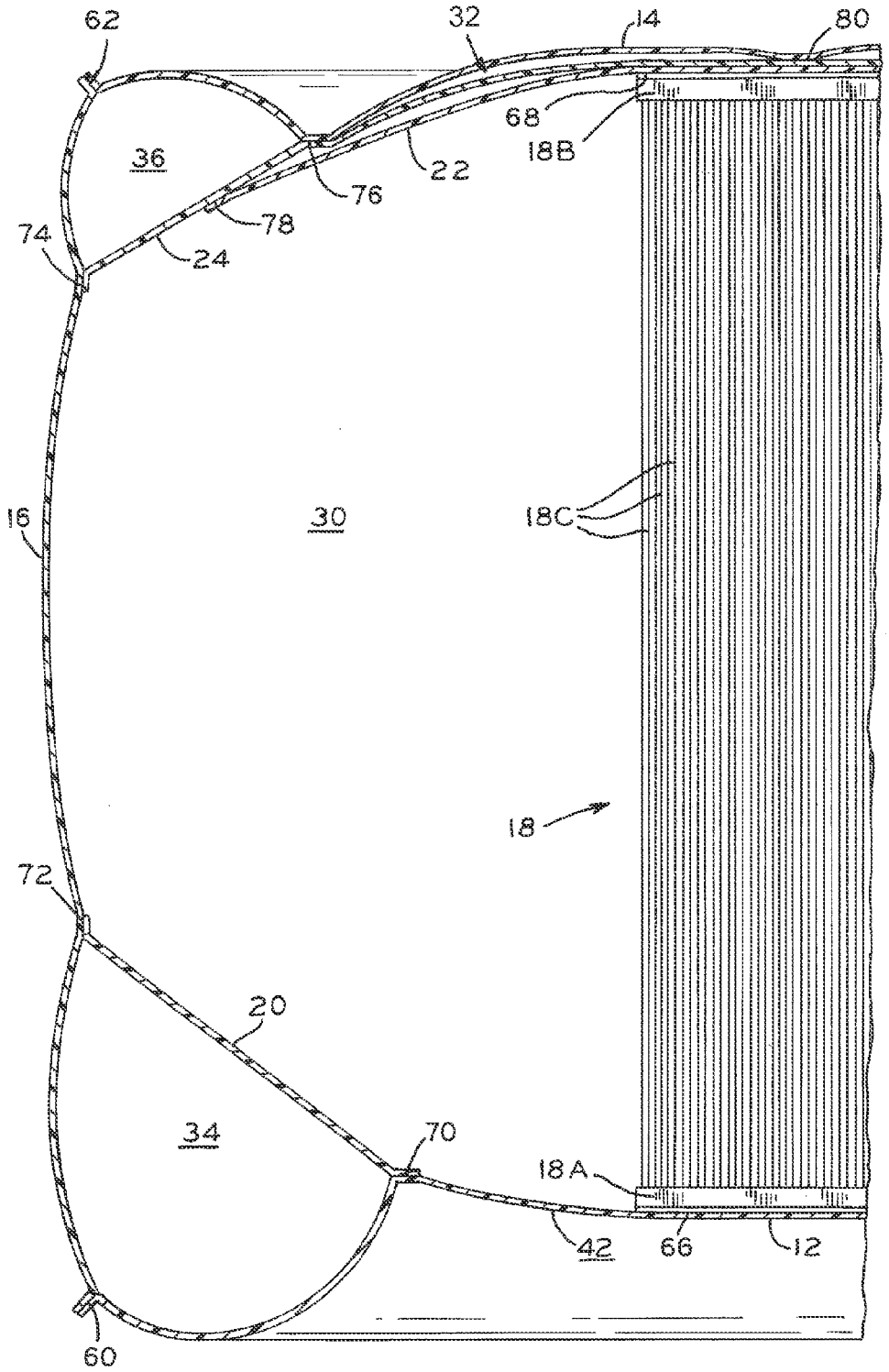
FIG. 3 is an elevation, cross-section view, taken along the line III-III of FIG. 1, illustrating respective air chambers of the inflatable mattress.

Turning now to FIG. 1, inflatable mattress 10 is illustrated in a fully inflated, ready-to-use configuration. As described in detail below, mattress 10 is a "double chamber" type design in which main air chamber 30 defines a majority of the height and overall shape of mattress 10, and upper air chamber 32 is disposed above main air chamber 30 and provides for the overall structure and feel of upper sleeping surface 40 of mattress 10. In addition, mattress 10 includes a lower peripheral air chamber 34 extending around the periphery of mattress 10 adjacent a lower, ground contacting surface 42 (FIG. 3).

Lower peripheral air chamber 34 (FIG. 3) provides a stable peripheral structure at the base of mattress 10 to prevent an undesirable rolling or buckling of the mattress sidewall, e.g., when a user sits on an edge of upper surface 40. Similarly, upper peripheral air chamber 36 (FIG. 3) extends around the outer periphery of upper surface 40, and provides a raised ridge-like structure to aid in the comfortable retention of a user on upper surface 40. In particular, upper peripheral air chamber 36 interrupts what might otherwise be a gradual downward sloping of upper surface 40 around the edges of mattress 10, thereby inhibiting any rolling or buckling the mattress sidewall 16 when a user is near an edge of upper surface 40.

Figure 4:
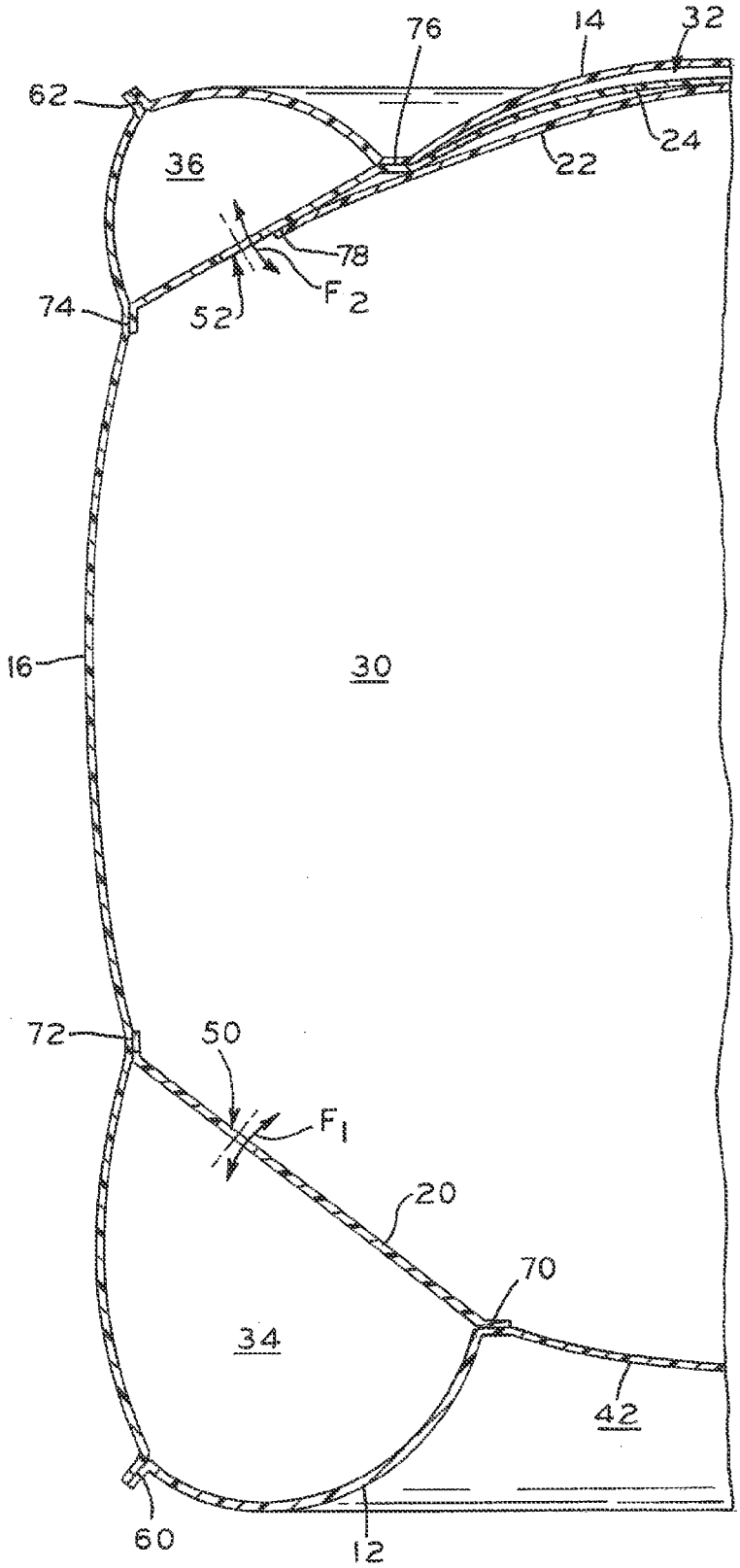
FIG. 4 is an elevation, cross-section view, taken along line IV-IV of FIG. 1, illustrating fluid communication apertures from the main air chamber to the lower and upper peripheral air chambers.
Figure 6:
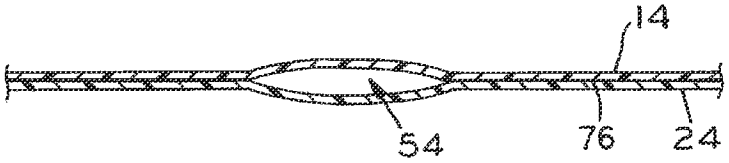
FIG. 6 is an elevation, partial cross-section view taken along the line VI-VI of FIG. 1, illustrating a fluid communication channel between the upper peripheral air chamber and upper air chamber of the mattress.

A single valve 26 located in one side of mattress 10 is used to inflate all of the air chambers 30, 32, 34, 36 of mattress 10. Valve 26 places the main air chamber 30 in direct fluid communication with the ambient atmosphere, such that main air chamber 30 can be directly pressurized via valve 26. By contrast, the lower and upper peripheral air chambers 34, 36 are in secondary fluid communication with the ambient atmosphere, via valve 26 and fluid communication apertures 50 and 52 respectively (as shown in FIG. 4 and further described below), while upper air chamber 32 is in tertiary fluid communication with the ambient atmosphere via apertures 52 and fluid communication channels 54 (shown in FIGS. 1 and 6 and also described further below).

For purposes of the present disclosure, "direct fluid communication" means fluid communication across a single barrier, such as a single sidewall formed by one of the various panels which form mattress 10 (further described below). "Secondary fluid communication" means fluid communication which must traverse two spatially separate structures, such as a first panel and a second panel which is spaced from the first panel, or two spaced-apart portions of a single panel. Similarly, "tertiary fluid communication" means fluid communication which occurs across three spatially separate structures, such as three spatially separate mattress panels or three spaced-apart portions of a single panel, or some combination thereof.

Figure 2:
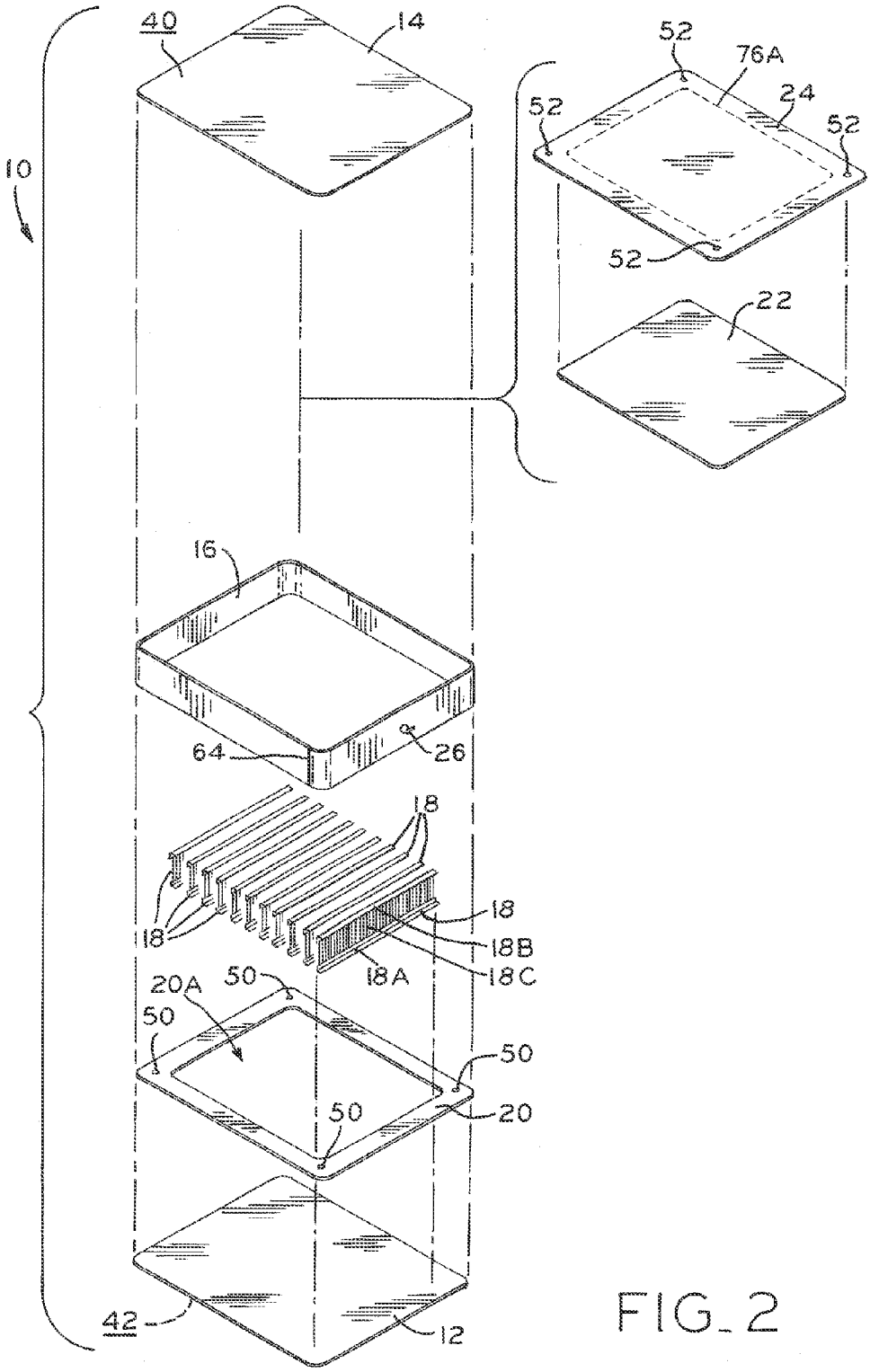
FIG. 2 is an exploded view of the mattress shown in FIG. 1.

Turning now to FIG. 2, an exploded view of mattress 10 illustrating its constituent parts is provided. The overall internal volume of mattress 10 is enclosed by bottom panel 12, top panel 14 and peripheral panel 16. In particular, a lower edge of peripheral panel 16 is hermetically bonded to the peripheral edge of bottom panel 12 at weld 60 (FIG. 1), while the opposing upper edge of peripheral panel 16 is hermetically bonded to the peripheral edge of top panel 14 at weld 62 (FIG. 1). When valve 26 is closed, bottom and top panels 12, 14 cooperate with peripheral panel 16 to define a hermetically sealed internal cavity of mattress 10 including air chambers 30, 32, 34 and 36. In an exemplary embodiment, peripheral panel 16 is formed from a strip of material whose ends are bonded at weld 64. Although welds formed by heating two adjacent materials to a melting or near-melting temperature are described herein as the method for joining two separate structures of mattress 10, it is contemplated that other methods, such as adhesive bonding, may also be used.

In order to provide the substantially box-shaped, mattress-like form of mattress 10, a series of tensioning assemblies 18 are positioned within the sealed cavity of mattress 10 and welded to bottom and top panels 12 and 14. In an exemplary embodiment, each tensioning assembly 18 includes a lower weld strip 18*a* bonded to bottom panel 12 at weld 66 (FIG. 3), upper weld strip 18*b* bonded to lower intermediate panel 22 (shown in FIG. 3 and described in further detail below), and a plurality of tension cords 18*c* with lower and upper ends bonded to weld strips 18*a*, 18*b* respectively. When mattress 10 is inflated, the tendency of bottom and top panels 12 and 14 to form a "balloon" shape with convex lower and upper surfaces 42, 40 is counteracted by the tension in cords 18*c*, such that tensioning assemblies 18 cooperate to provide the generally rectangular mattress like shape of inflatable mattress 10 with substantially flat upper and lower surfaces 40, 42.

Further discussion of an exemplary embodiment of tensioning assemblies 18 in the context of an inflatable mattress can be found in International Patent Application Publication No. WO 2013/130117, filed Jun. 12, 2012 and entitled "Internal Tensioning Structure Useable with Inflatable Devices," and in U.S. patent application Ser. No. 14/444,453, filed Jul. 28, 2014 and entitled "Method for Producing an Inflatable Product," and U.S. patent application Ser. No. 14/444,337, filed Jul. 28, 2014 and entitled "Method for Producing an Air Mattress," all of which are commonly assigned with the present application, the entire disclosures of which are hereby expressly incorporated herein by reference.

As best seen in FIGS. 3 and 4, mattress 10 includes lower peripheral panel 20, which cooperates with bottom panel 12 and peripheral panel 16 to define lower peripheral air chamber 34. As shown in FIG. 2, lower peripheral panel 20 is formed as a generally rectangular sheet of material having approximately the same outer peripheral dimensions as bottom panel 12, and has a large central aperture 20A having a corresponding rectangular shape. The outer periphery and central aperture 20A of panel 20 cooperate to define a rectangular strip of material of a substantially constant width around its periphery, as illustrated. Lower peripheral panel 20 is bonded along its inner peripheral edge to bottom panel 12 at weld 70, while the outer peripheral edge of panel 20 is affixed to peripheral panel 16 at weld 72. Both of welds 70 and 72 extend around the entire periphery of panels 12, 16 and 20 thereby forming lower peripheral air chamber 34 around the entire lower periphery of mattress 10. Thus, lower peripheral air chamber 34 is bounded by bottom panel 12, peripheral panel 16 and lower peripheral panel 20, in cooperation with welds 60, 70 and 72 extending around the peripheral extent of mattress 10.

In order to provide for pressurization of lower peripheral air chamber 34, lower peripheral panel 20 includes fluid communication apertures 50, as shown in FIG. 2. In the illustrated embodiment, apertures 50 are provided at each of the four corners of the rectangular shape of panel 20, in order to promote even air inflows during inflation to the entire periphery of peripheral air chamber 34. Of course, it is contemplated that additional fluid communication apertures 50 may be provided, or that as few as one aperture 50 may be provided as required or desired for a particular application. As shown in FIG. 4, aperture 50 allows for the flow $F_1$ of fluid (e.g., air) from main air chamber 30 to lower peripheral air chamber 34 during inflation of mattress 10, as well as a reverse fluid flow from chamber 34 to chamber 30 during deflation. Thus, air flowing through valve 26 is in direct fluid communication with main air chamber 30, and in secondary fluid communication with lower peripheral air chamber 34 via aperture 50.

Upper air chamber 32 and upper peripheral air chamber 36 are bounded by one or both of lower and upper intermediate panels 22 and 24, shown in FIG. 2, in cooperation with top panel 14 and peripheral panel 16. Upper intermediate panel 24 has an outer periphery defining a size and shape substantially the same as top panel 14, i.e., generally rectangular. The outer peripheral edge of upper intermediate panel 24 is affixed to peripheral panel 16, as shown in FIG. 3, along weld 74, which extends around the entire periphery of upper intermediate panel 24 and peripheral panel 16, in similar fashion to weld 72 between lower peripheral panel 20 and peripheral panel 16 as described above. Upper intermediate panel 24 further defines an interior weld path 76*a* as shown in FIG. 2, which is a location spaced substantially evenly inwardly from the outer periphery of panel 24 where weld 76 provides affixation of panel 24 to top panel 14 (FIG. 3).

Upper peripheral air chamber 36 is bounded by top panel 14, peripheral mattress panel 16 and upper intermediate panel 24, in cooperation with welds 62, 74 and 76 extending around the peripheral extent of mattress 10. Similar to lower peripheral panel 20, upper intermediate panel 24 includes fluid communication apertures 52 at each corner thereof, as shown in FIG. 2. Apertures 52 allow secondary fluid communication between main air chamber 30 and upper peripheral air chamber 36, in the form of fluid flow $F_2$ (FIG. 4).

Figure 5:
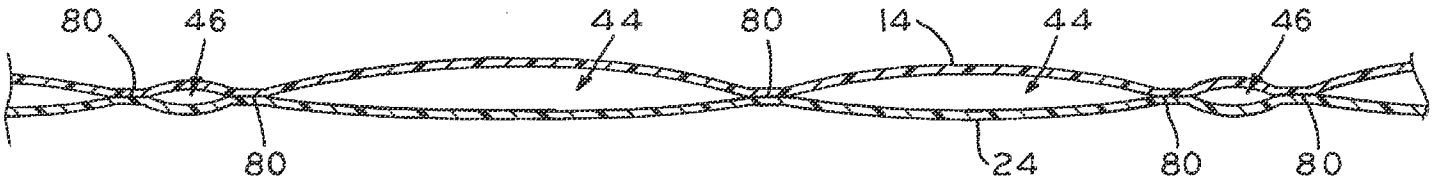
FIG. 5 is an elevation, partial cross-section view taken along line V-V of FIG. 1, illustrating air pockets and fluid communication channels which cooperate to define the sleeping surface of the mattress.

Upper air chamber 32 is disposed beneath top panel 14, and is generally bounded by top panel 14 at its upper end and upper intermediate panel 24 at is lower end (see, e.g., FIG. 5). Weld 76 forms the peripheral boundary of upper air chamber 32. However, as described in further detail below, weld 76 is interrupted at one or more locations, illustratively two mutually opposed locations, in order to form fluid communication channels 54 (FIG. 6) to facilitate fluid flow from upper peripheral air chamber 36 to upper air chamber 32.

Lower intermediate panel 22 has a shape which generally corresponds to the shape of upper intermediate panel 24, except lower intermediate panel 22 is somewhat smaller. Thus, the outer edge of lower intermediate panel 22 is affixed to a lower surface of upper intermediate panel 24 at weld 78, which extends around the entire periphery of lower intermediate panel 22 and is inset from the outer periphery of upper intermediate panel 24. In an exemplary embodiment, this inset is substantially constant around the entire outer periphery of panels 22, 24. As shown in FIG. 3, weld 78 may be located between weld 74 and weld 76, both horizontally and vertically. As noted above and illustrated in FIG. 3, upper weld strips 18*b* of tensioning assemblies 18 are affixed to lower intermediate panel 22 via welds 68. The presence of lower intermediate panel 22 allows welds 68 to be made at a material interface not in direct contact or physical abutment with a majority of sleeping surface 40, such that any surface irregularities which might result from the presence of welds 68 will not be felt by a user of mattress 10.

Although upper intermediate panel 24 is shown as a single, monolithic sheet of material, it is contemplated that other arrangements could be utilized within the scope of the present disclosure. For example, upper intermediate panel could be formed from a strip of material cut into a rectangular shape, similar to bottom panel 12, with a central panel similar to lower intermediate panel 22 bonded to the interior periphery of the strip to fill in its aperture.

Turning again to FIG. 1, sleeping surface 40 of upper air chamber 32 has a "quilted" pattern appearance arising from a plurality of zigzag welds 80 arranged as illustrated. Further depiction and graphical description of an exemplary form of zigzag welds 80 can be found in U.S. Design application Ser. No. 29/502,063, filed Sep. 11, 2014 and entitled "Inflatable Mattress", which is commonly assigned with the present application, the entire disclosure of which is hereby incorporated by reference herein.

As best seen in FIG. 5, upper air chamber 32 is formed in the space between top panel 14 and upper intermediate panel 24, and within the boundary circumscribed by upper weld 76 between panels 14 and 24 (FIG. 1). Pressurized fluid (e.g., air) enters upper air chamber 32 via fluid communication channels 54, formed by a pair of mutually opposed interruptions in weld 76. As noted above, air entering through valve 26 flows into main air chamber 30, and then into upper peripheral air chamber 36 via fluid communication apertures 52. As pressurized air occupies upper peripheral air chamber 36, it is allowed to flow through channels 54 into upper air chamber 32. Thus, upper air chamber 32 is in tertiary fluid communication with valve 26, because air arriving to upper air chamber 32 flows from valve 26 via main air chamber 30 and upper peripheral air chamber 36. By contrast and as noted above, upper peripheral air chamber 36 is in secondary fluid communication with valve 26 while main air chamber 30 is in direct fluid communication therewith.

As best seen in FIG. 1, zigzag welds 80 are formed within the boundary of upper air chamber 32 established by the peripheral weld 76. Zigzag welds 80 each define alternating lateral and longitudinal sections joined by respective radiused transitions. Neighboring pairs of these radiused transitions are arranged facing one another such that neighboring pairs of zigzag welds 80 form pockets 44 substantially bounded by mutually opposed pairs of lateral and longitudinal weld sections, as illustrated. Each of pockets 44 presents a generally rectangular appearance with two opposing open corners adjacent the radiused transitions of welds 80. These opposing corners cooperate to define pocket fluid channels 46 (FIG. 5), which allow air to flow diagonally between adjacent pockets 44 through a gap between neighboring welds 80.

Thus, as air enters upper air chamber 32 via fluid communication channel 54 (FIG. 1), the air infiltrates each of pockets 44 via pocket fluid channels 46. Diagonally neighboring pairs of pockets 44, a plurality of which are formed by each neighboring pair of zigzag welds 80, are all in direct fluid communication with one another via fluid communication channels 54.

In this way, sleeping surface 40 is defined by a quilted arrangement of inflated pockets 44, all of which are relatively flat and spaced away from lower intermediate panel 22 and its welds 68 (described in further detail above). Meanwhile, upper peripheral air chamber 36 provides a ridged boundary around the periphery of sleeping surface 40, presenting a physical barrier to any downward slope of sleeping surface 40 around the edges of mattress 10, thereby providing stability and security for users of mattress 10.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A multi-chamber inflatable mattress comprising:
- a bottom panel;
- a top panel spaced from the bottom panel and defining an upper sleeping surface of the mattress;
- a peripheral panel bonded to the bottom panel and the top panel to define an internal mattress cavity;
- an upper intermediate panel disposed between the top panel and the bottom panel;
- a lower intermediate panel disposed between the bottom panel and the upper intermediate panel;
- a valve in fluid communication with the internal mattress cavity such that the mattress can be inflated and deflated via the valve;
- a main air chamber bounded by the bottom panel, the top panel and the peripheral panel, the main air chamber in direct fluid communication with an ambient atmosphere via the valve;
- an upper peripheral air chamber disposed at a periphery of the top panel, the upper peripheral air chamber in direct fluid communication with the main air chamber and in secondary fluid communication with the ambient atmosphere; and
- an upper air chamber disposed between the top panel and the upper intermediate panel, the upper air chamber in direct fluid communication with the upper peripheral air chamber, in secondary fluid communication with the main air chamber and in tertiary fluid communication with the ambient atmosphere.

2. The multi-chamber inflatable mattress of claim 1, wherein the upper air chamber is bounded by the top panel, the upper intermediate panel and a peripheral weld formed between the top panel and the upper intermediate panel, the peripheral weld having at least one interruption forming a fluid communication channel with the upper peripheral air chamber.

3. The multi-chamber inflatable mattress of claim 2, wherein the upper air chamber includes a plurality of zigzag welds formed between the top panel and the upper intermediate panel and within the boundary of the peripheral weld.

4. The multi-chamber inflatable mattress of claim 3, wherein the plurality of zigzag welds define alternating lateral and longitudinal sections joined by respective radiused transitions, such that neighboring pairs of the plurality of zigzag welds define air pockets within the upper air chamber.

5. The multi-chamber inflatable mattress of claim 4, wherein neighboring pairs of pockets formed by the neighboring pairs of zigzag welds are in fluid communication with one another via fluid communication channels formed between neighboring pairs of the radiused transitions.

6. The multi-chamber inflatable mattress of claim 1, wherein the upper peripheral air chamber is bounded by the top panel, the peripheral panel and the upper intermediate panel.

7. The multi-chamber inflatable mattress of claim 1, wherein the upper intermediate panel includes at least one fluid communication aperture positioned to allow fluid flow between the main air chamber and the upper peripheral air chamber.

8. The multi-chamber inflatable mattress of claim 1, further comprising a lower peripheral air chamber disposed at a periphery of the bottom panel, the lower peripheral air chamber in secondary fluid communication with the valve and direct fluid communication with the main air chamber.

9. The multi-chamber inflatable mattress of claim 8, further comprising a lower peripheral panel formed as a rectangular strip of material defining an inner periphery and an outer periphery, the inner periphery bonded to the bottom panel, the outer periphery bonded to the peripheral panel, wherein the lower peripheral air chamber is bounded by the bottom panel, the peripheral panel and the lower peripheral panel.

10. The multi-chamber inflatable mattress of claim 9, wherein the lower peripheral panel includes at least one fluid communication aperture positioned to allow fluid flow between the main air chamber and the lower peripheral air chamber, whereby air flowing through the valve is in direct fluid communication with the main air chamber and in secondary fluid communication with the lower peripheral air chamber via the aperture.

11. The multi-chamber inflatable mattress of claim 1, wherein the upper intermediate panel has an outer periphery defining a size and shape substantially the same as the top panel.

12. The multi-chamber inflatable mattress of claim 1, further comprising at least one tensioning assembly positioned within the internal mattress cavity and bonded to the bottom panel and the lower intermediate panel.

13. The multi-chamber inflatable mattress of claim 12, wherein the at least one tensioning assembly comprises:
- a lower weld strip bonded to the bottom panel;
- an upper weld strip bonded to the lower intermediate panel; and
- a plurality of tension cords each having a lower end bonded to the lower weld strip and an upper end bonded to the upper weld strip.

14. A multi-chamber inflatable mattress comprising:
- a main air chamber defined by a ground-contacting surface and a peripheral wall extending upwardly from the ground-contacting surface, the main air chamber in direct fluid communication with an ambient atmosphere via a valve disposed in the peripheral wall;
- an upper air chamber disposed above the main air chamber with least two intermediate panels between the main air chamber and the upper air chamber, the upper air chamber defined by a sleeping surface; and
- an upper peripheral air chamber disposed at a periphery of an upper edge of the peripheral wall of the main air chamber, the upper peripheral air chamber in direct fluid communication with the main air chamber and in secondary fluid communication with the ambient atmosphere, the upper air chamber in direct fluid communication with the upper peripheral air chamber, in secondary fluid communication with the main air chamber and in tertiary fluid communication with the ambient atmosphere.

15. The multi-chamber inflatable mattress of claim 14, further comprising a lower peripheral air chamber disposed at a periphery of the ground-contacting surface, the lower peripheral air chamber in direct fluid communication with the main air chamber and secondary fluid communication with the ambient atmosphere.

16. The multi-chamber inflatable mattress of claim 14, wherein the upper air chamber includes a plurality of zigzag welds forming pockets in a quilted pattern.

17. The multi-chamber inflatable mattress of claim 14, further comprising a plurality of tensioners disposed in the main air chamber and operable to impart a box-shape to the inflatable mattress.

18. A multi-chamber inflatable mattress comprising:

a main air chamber;

an upper peripheral air chamber;

an upper air chamber;

first means for inflating and deflating the main air chamber, said first means placing the main air chamber in direct fluid communication with an ambient atmosphere;

second means for inflating and deflating the upper peripheral air chamber, said second means placing the upper peripheral air chamber in secondary fluid communication with the ambient atmosphere; and third means for inflating and deflating the upper air chamber, said third means placing the upper air chamber in tertiary fluid communication with the ambient atmosphere.

19. The multi-chamber inflatable mattress of claim 18, further comprising:

a lower peripheral air chamber;

fourth means for inflating and deflating the lower peripheral air chamber, said fourth means placing the lower peripheral air chamber in secondary fluid communication with the ambient atmosphere.

20. The multi-chamber inflatable mattress of claim 18, further comprising tensioning means for imparting a box-shape to the inflatable mattress.

* * * * *

UNITED STATES PATENT AND TRADEMARK OFFICE

CERTIFICATE OF CORRECTION

PATENT NO. : 9,247,827 B2
APPLICATION NO. : 14/599091
DATED : February 2, 2016
INVENTOR(S) : Hua Hsiang Lin et al.

It is certified that error appears in the above-identified patent and that said Letters Patent is hereby corrected as shown below:

On the title page item (71) Applicant: Delete "Corporation" and insert --Corp.--

Signed and Sealed this
Third Day of May, 2016

Michelle K. Lee

Michelle K. Lee
*Director of the United States Patent and Trademark Office*